US005117588A

United States Patent [19]

Osborn et al.

[11] Patent Number: 5,117,588

[45] Date of Patent: Jun. 2, 1992

[54] SEMI-AUTOMATIC DRESSING ACCESSORY

[76] Inventors: Warren J. Osborn, 10400 Plum Tree Cir., P.O. Box 405, Hales Corners, Wis. 53130; James L. Geske, 408 Kensington Dr., McHenry, Ill. 60050

[21] Appl. No.: 629,941

[22] Filed: Dec. 19, 1990

Related U.S. Application Data

[63] Continuation-in-part of Ser. No. 369,263, Jun. 21, 1989, abandoned.

[51] Int. Cl.[5] ..... B24B 53/08

[52] U.S. Cl. ..... 51/5 D; 125/11.06; 125/11.20

[58] Field of Search ..... 125/11.07, 11.06, 11.05, 125/11.20, 11.19; 51/5 D, 325

[56] References Cited

U.S. PATENT DOCUMENTS

| | | | |
|---|---|---|---|
| 2,938,515 | 5/1960 | Hoglund | 125/11.05 |
| 3,040,487 | 6/1962 | Kampe | 125/11.06 |
| 3,155,086 | 11/1964 | Örnehage | 125/11.06 |
| 3,162,186 | 12/1964 | Montanus | 125/11.06 |
| 3,870,030 | 3/1975 | Sollami | 125/11.06 |

*Primary Examiner*—Robert A. Rose

*Attorney, Agent, or Firm*—Fuller, Ryan & Hohenfeldt, S.C.

[57] ABSTRACT

A dresser apparatus for dressing a grinding wheel to a desired cross sectional shape, the apparatus including a dresser frame connected to a stationary dresser base, and a slider block slidably connected to the dresser frame. A follower frame is mounted to the slider block for sliding movement with respect to the slider block in a second, substantially vertical direction. Linear actuator means are disclosed for causing the slider block to slide in the first direction with respect to the dresser frame. A cam is provided, corresponding to the desired shape of the grinding wheel, and a cam follower is attached to the follower frame and postioned thereon so as to bear on the cam surface. In one embodiment the cam follower causes the follower frame to move in the second direction according to the shape of the cam surface while the linear actuator means moves the slider block in the first direction. In another embodiment, directed to dressing wheels with a flat or reverse angled surface, a second linear actuator provides the vertical movement. A grinding wheel dressing tool is affixed to the dresser arm and positioned so as to bear on and dress the grinding wheel in conformity with the shape of the cam surface. The dressing tool is attached to the dresser arm, and the cam follower to the follower frame, at an oblique angle with respect to the grinding wheel axis.

15 Claims, 4 Drawing Sheets

Fig. 3
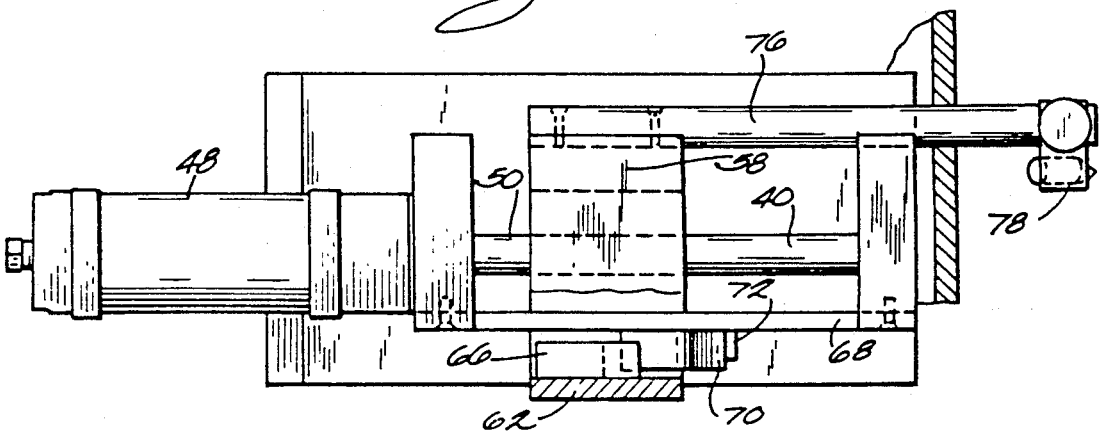
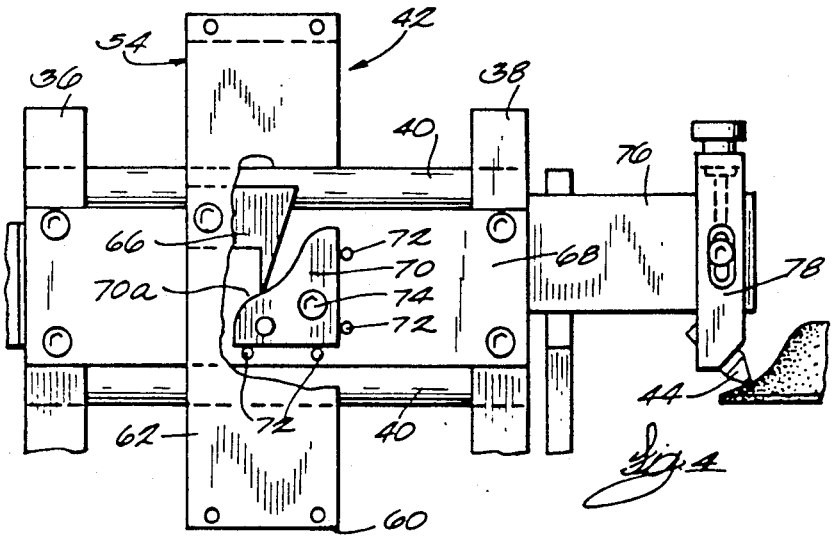
Fig. 4
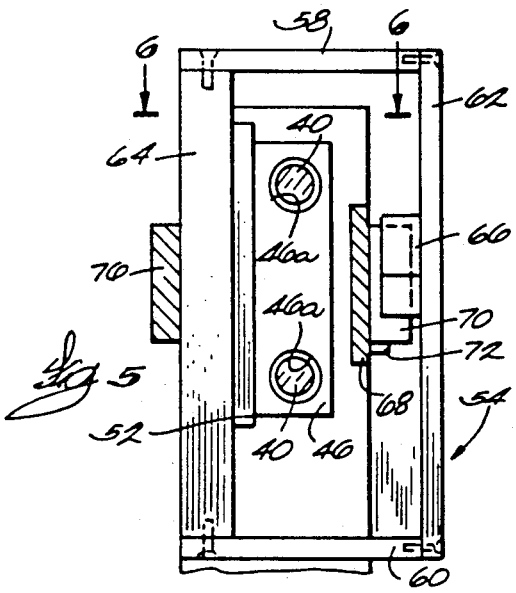
Fig. 5
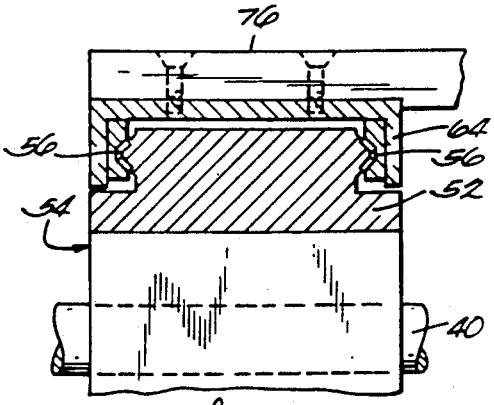
Fig. 6

SEMI-AUTOMATIC DRESSING ACCESSORY

CROSS-REFERENCE TO RELATED APPLICATION

This application is a continuation-in-part of Ser. No. 07/369,263, filed on June 21, 1989, now abandoned.

BACKGROUND OF THE INVENTION

This invention relates to accessories for drill pointing machines, or machines for sharpening drill bits, and in particular to such accessories which are provided for the purpose of dressing the grinding wheels of such drill pointing machines.

Drill pointing machines as shown in Winslow, U.S. Pat. No. 3,040,480, are generally well known, and are important to machine shops to keep a supply of relatively sharp and properly pointed drill bits on hand. As is also shown in that patent, the grinding wheels used in drill pointing machines as there described tend to wear and lose their proper shape with use, this proper shape being important to proper shaping of the drill point being ground. This loss of shape of the grinding wheel requires a grinding or "dressing" operation to be periodically performed on the wheel to restore it to proper form and shape. Since the drill pointing operation is generally automatic, it is desirable for the dressing operation to be as automatic as possible also.

The Winslow patent shows a dressing apparatus which dresses the grinding wheel according to the shape of a cam, with respect to which a cam follower is moved by a power cylinder. However, in the Winslow apparatus the cylinder moves the cam follower along the surface of the cam, and the dresser tool is held against the wheel solely by the force of a spring. This arrangement can result in less dressing force being applied to the dressing tool and in turn to the wheel. Further, the dressing tool in Winslow is disclosed to be held perpendicular to the axis of rotation of the wheel. In addition, the Winslow patent discloses a dressing apparatus which is designed for application to a specific drill pointing machine.

Montanus, U.S. Pat. No. 3,162,186, shows a dresser apparatus for a grinding wheel including a traverse motor which moves a cam follower along a cam so that a dressing tool is moved both vertically and horizontally. Here again dressing tool is disclosed to be held perpendicular to the axis of rotation of the wheel. In addition the Montanus apparatus is limited as to the wheel shapes it is capable of dressing, requiring that there be smooth curves and no flat vertical faces or reverse angles.

Hoaglund, U.S. Pat. No. 2,938,515 shows a contour forming apparatus which carries a diamond cutting tool at an oblique angle.

This invention relates to improvements to the apparatus described above, to solutions to the problems raised thereby, and to apparatus for other drill pointing machines.

SUMMARY OF THE INVENTION

None of the patents set forth above permits the dresser apparatus to dress a wheel requiring a face with a backward angle, or even for that matter a flat face. It is an object of this invention to provide for such an apparatus.

To this end the apparatus of the invention includes a dresser base affixed substantially immovable with respect to the drill pointer base. A dresser frame is connected to the dresser base, and a follower frame slidably connected to the dresser frame. The follower frame includes a follower carriage mounted to the dresser frame for sliding movement with respect to the dresser frame in a first, substantially horizontally radially inward-and-outward direction. A dresser arm is mounted to the follower carriage for sliding movement with respect to the follower carriage in a second direction substantially parallel to the axis of rotation of the grinding wheel. The apparatus further includes linear actuator means for causing the follower frame to slide back and forth in the first direction. A cam is provided, corresponding to the desired shape of the grinding wheel, and a cam follower is attached to the follower frame and positioned thereon so as to bear on the cam surface, thereby causing the follower frame to move in the second direction according to the shape of the cam surface while the linear actuator means moves the follower frame in the first direction. A grinding wheel dressing tool is affixed to the dresser arm and positioned so as to bear on and dress the grinding wheel in conformity with the shape of the cam surface. The dressing tool is attached to the dresser arm at an oblique angle with respect to the grinding wheel axis. The dresser frame is slidable with respect to the dresser base, permitting adjustment of the apparatus for removal of material from the grinding wheel in the dressing operation, by means of a screw, including markings for indicating the distance the dresser frame has been adjusted with respect to the dresser base.

In one embodiment directed to a wheel with a flat face or a reverse angle of incline, the follower frame moves in the first direction until the follower contacts the cam. Upon that occurrence the dresser arm is caused to move in the second direction by a second linear actuator means, and the first linear actuator means is constructed so as to permit reverse movement if necessary.

Other objects and advantages of the invention will become apparent hereinafter.

DESCRIPTION OF THE DRAWING

FIG. 3 is a top plan view, partially cut away, of the apparatus shown in FIG. 1.

FIG. 4 is a fragmentary side view of the apparatus shown in FIG. 1, in a different operative position than that shown in FIG. 1.

FIG. 5 is a cross-sectional view of the apparatus shown in FIG. 1, taken substantially along line 5—5 of FIG. 1.

FIG. 6 is a cross-sectional view, on an enlarged scale, of the apparatus shown in FIG. 5, taken substantially along line 6—6 of FIG. 5.

FIG. 9 is a schematic diagram of the pneumatic and hydraulic controls for the apparatus shown in FIGS. 7 and 8.

DESCRIPTION OF THE PREFERRED EMBODIMENTS

Figure 1:
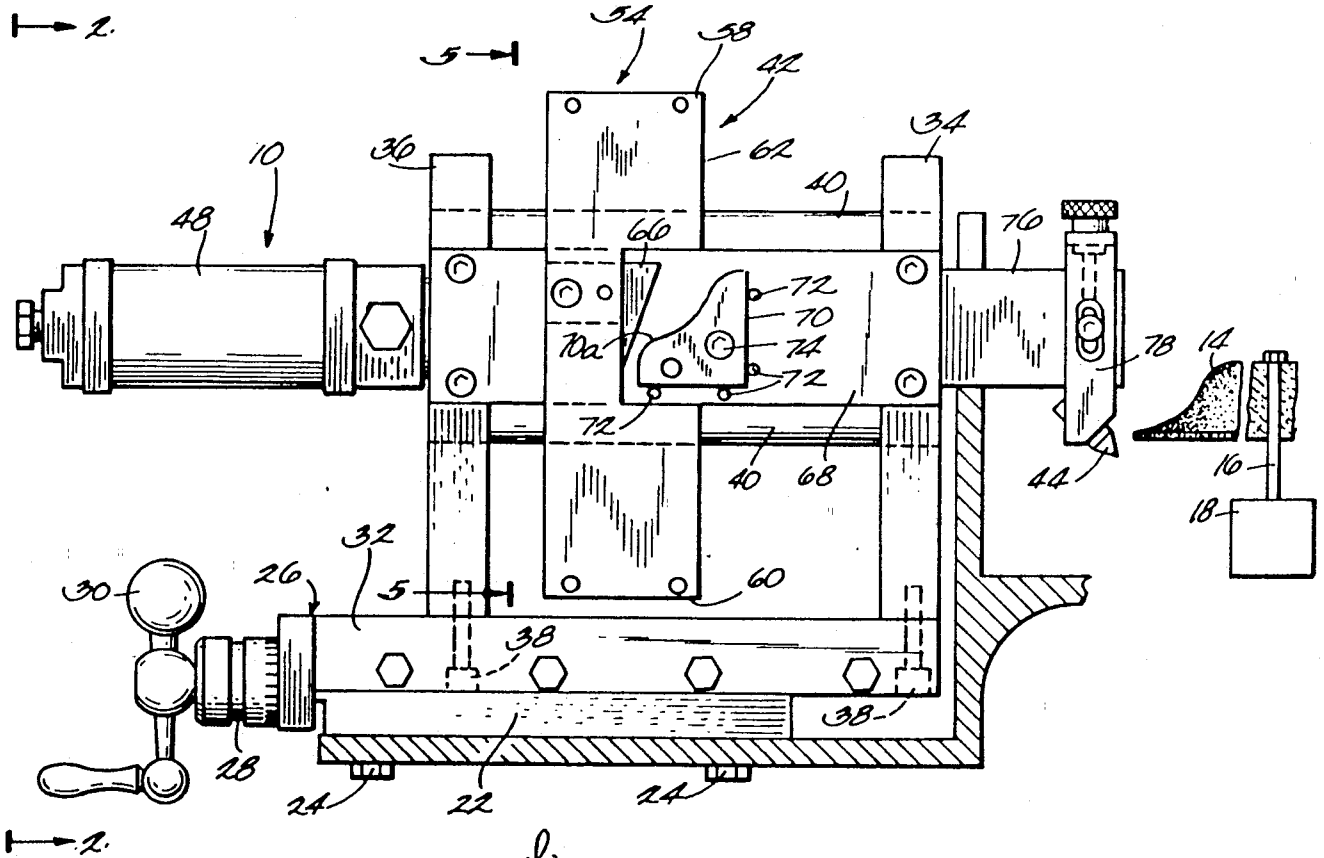
FIG. 1 is a side elevation view of an apparatus constructed according to one embodiment of the invention.

Referring now to FIG. 1, the apparatus 10 constructed according to a preferred embodiment of the invention is a grinding wheel dressing apparatus designed as an accessory to a drill pointing machine 12. As is conventional for such machines, the drill pointing machine 12 includes a grinding wheel 14, which is continuously rotated about an axis 16 by any suitable prime mover, shown schematically at 18. While it is generally conventional that the axis 16 be substantially vertical, the invention is in no way intended to be limited to any one particular orientation. Any relative directions referred to herein, such as vertical or horizontal, are for ease of reference only.

The drill pointing machine 12 generally includes a stationary base 20, which provides support to the prime mover 18 and via bearings (not shown) to the grinding wheel 14. The grinding wheel 14 will generally have a cross section which, when taken perpendicularly to the axis 16, is substantially circular.

According to the invention, the dressing apparatus 10 includes a dresser base 22 immovably affixed such as by screws 24 to the stationary base 20. A dresser frame 26 is slidably connected to the dresser base 22 in such a manner that the dresser frame may be continuously moved along the dresser base, radially toward and away from the grinding wheel 14. The purpose of permitting this movement is to provide a means for moving the apparatus 10 with respect to the wheel 14, thus compensating for the material removed from the wheel in the dressing and drill bit grinding operations. The movement is preferably continuous or, more explicitly, continuously variable, so as to provide for even small changes in the size of the wheel 14. In the embodiment shown, this continuous movement is accomplished by means of a screw 28, which is oriented substantially radially with respect to the wheel 14, journaled to the dresser frame 26 and threaded into the dresser base 22. A crank handle 30 may be provided, attached to an end of the screw 28, to facilitate the turning of the screw and thus the positioning of the apparatus 10 with respect to the wheel 14.

The dresser frame 26 includes a dresser frame base plate 32 and a pair of substantially vertically oriented support plates 34 and 36 spaced apart from each other. Front plate 34 is attached to an end of the base plate 32 proximal to the wheel 14, while back plate 36 attached to an end of the base plate distal from the wheel 14. The two plates 34 and 36 are oriented in spaced-apart substantially parallel planes, each substantially perpendicular to the same radial of wheel 14. The plates 34 and 36 are secured to the dresser frame base plate 32 by any suitable means, such as bolts 38 or welds (not shown), or may be integrally formed therewith. The dresser frame 26 also includes a pair of slider rods 40 affixed between the front plate 34 and back plate 36, substantially horizontally oriented and arranged in parallel spaced apart relation to each other. In the embodiment shown the rods 40 are arranged vertically, one above the other, but their relative arrangement may be otherwise, as long as they are substantially parallel with each other and substantially perpendicular to the front and back plates 34 and 36.

A follower carriage 42 is slidably connected to the slider rods 40. To the follower carriage 42 is affixed a conventional dresser tool bit 44, positioned so as to bear upon the wheel 14. The precise positioning of the dresser tool bit 44 will be treated in more detail subsequently herein.

Figure 2:
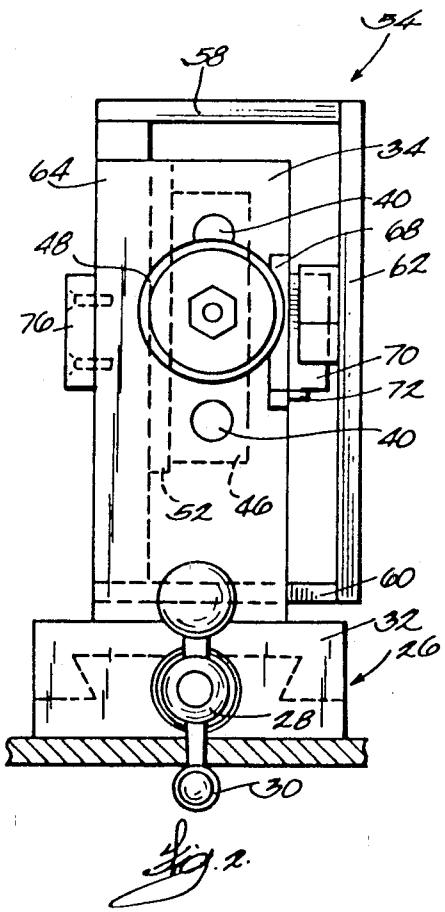
FIG. 2 is an end view of the apparatus shown in FIG. 1, taken from the left end as viewed in FIG. 1.

In the preferred embodiment, the follower carriage 42 includes a slider block 46, shown best in FIGS. 2, 3 and 5, which is a generally rectangular solid, having longitudinal apertures 46*a* (FIG. 5) formed therein sized and positioned to fit somewhat loosely over the slider rods 40 to permit the slider block to slide along the rods. A linear actuator 48 is provided for moving the slider block 46 along the slider rods 40. This linear actuator 48 may be any suitable structure for the purpose, such as a hydraulic or pneumatic cylinder, or other linear actuator. The linear actuator 48 is mounted to the dresser frame 26, such as to the back plate 36, and includes an actuated member 50, such as a cylinder rod, attached to the slider block 46. Hence when the linear actuator 48 moves or actuates the member 50, the slider block 46 is caused thereby to move in a corresponding direction along the rods 40.

As shown best in FIGS. 3, 5 and 6, a bearing block 52 is secured to the side of the slider block 46. A follower frame 54 is connected to the bearing block 52 so as to be vertically movable with respect thereto. As shown most clearly in FIG. 6, the connection between the follower frame 54 and the bearing block 52 is by means of vertically oriented bearings 56. In the embodiment shown, the follower frame 54 is an open rectangular shaped member made up of four flat parts, a top plate 58 and a bottom plate 60 connected together by two side plates 62 and 64. Referring again to FIG. 6, side plate 64 is the portion of the follower frame 54 which is mounted to the bearing block 52 by means of bearings 56.

To side plate 62, opposite side plate 64, is affixed a cam follower 66. To the corresponding side of the back plate 36 and front plate 38 is affixed a cam carrier bracket 68, to which is removably affixed a cam 70. Any suitable secure but removable means may be employed for affixing the cam 70 to the cam carrier bracket 68. In the embodiment shown, the cam 70 is affixed by resting it upon dowel pegs 72 secured to the cam carrier bracket, and also by a bolt 74. The cam 70 and the cam follower 66 are positioned on their respective mountings with respect to each other so that the cam follower bears upon the cam surface 70*a* of the cam 70. Then as the linear actuator 48 moves slider block 46 with respect to the dresser frame 26, the cam 70 causes the cam follower 66 and hence the follower frame 54 to move upward as well as forward, or permits the follower frame to move downward as well as backward, according to the shape of the cam surface 70*a*. One end of a dresser arm 76 is affixed to the side plate 64 to which the bearings 56 are attached. The opposite end of the dresser arm 76 carries the dresser tool 78 which, as indicated earlier, holds the dresser tool bit 44 in contact with the surface of the grinding wheel 14. Accordingly the dresser tool bit 44 moves corresponding to the cam surface 70*a*, along with the follower frame 54 as described above.

As can be seen in FIGS. 1 and 4, the dresser bit 44 is mounted in the dresser tool 78 at an oblique angle, rather than strictly vertical or horizontal. This angled mounting is to permit the bit 44 to maintain contact with the surface of the grinding wheel 14 even though the cam surface 70*a* may have portions that are too rounded or flat for conventional dresser bits. For example, the dresser tool bit shown in the Winslow patent, referred to earlier, is held fully horizontally, and would not function to dress a wheel according to a cam with a concave surface or with a rounded top surface. In the present invention, the angle of this mounting is most preferred to be 50 degrees with respect to the tool 78, to yield the greatest flexibility in shapes of surfaces to be accommodated by the apparatus 10, and certainly at least 40 to 60 degrees.

Figure 8:
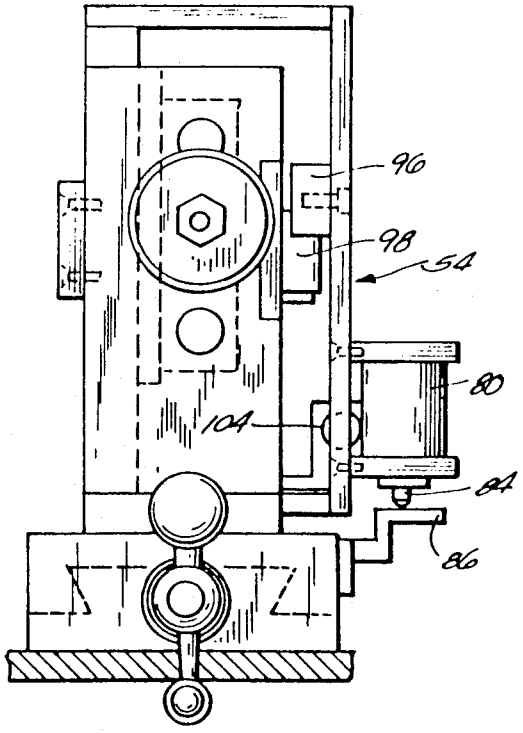
FIG. 8 is an end view of the apparatus shown in FIG. 7, taken from the left end as viewed in FIG. 7.
Figure 7:
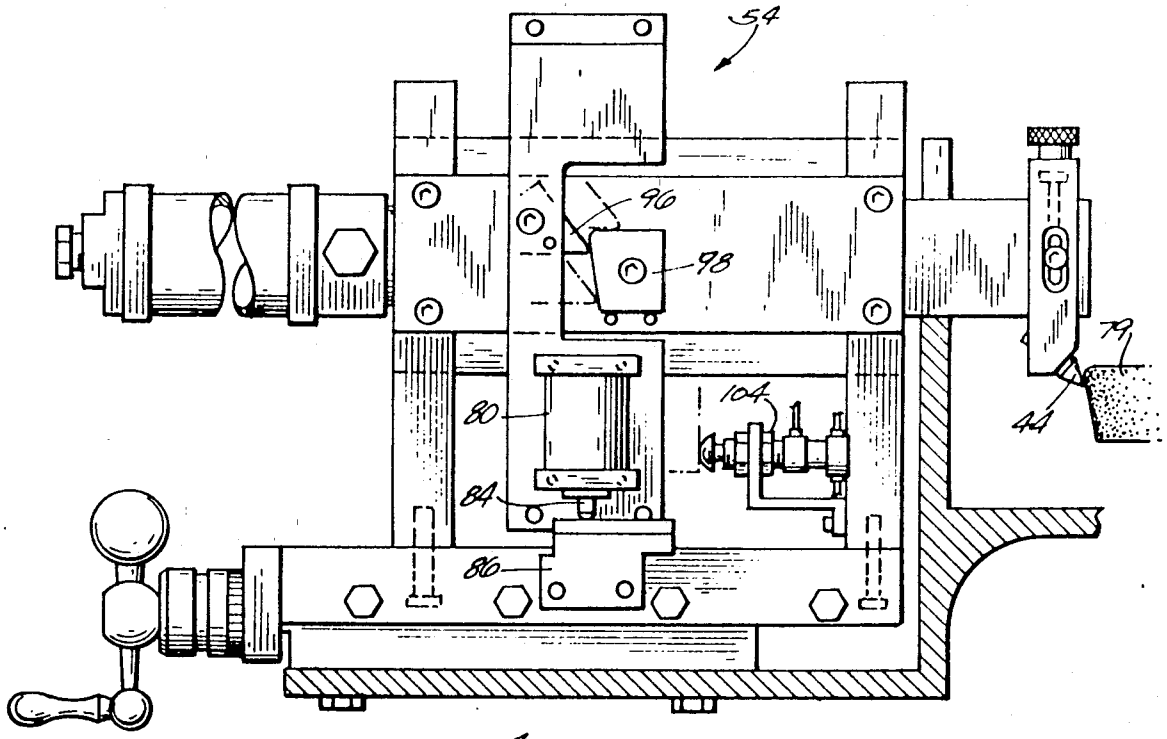
FIG. 7 is a side elevation view of an apparatus constructed according to different embodiment of the invention.
Figure 2:
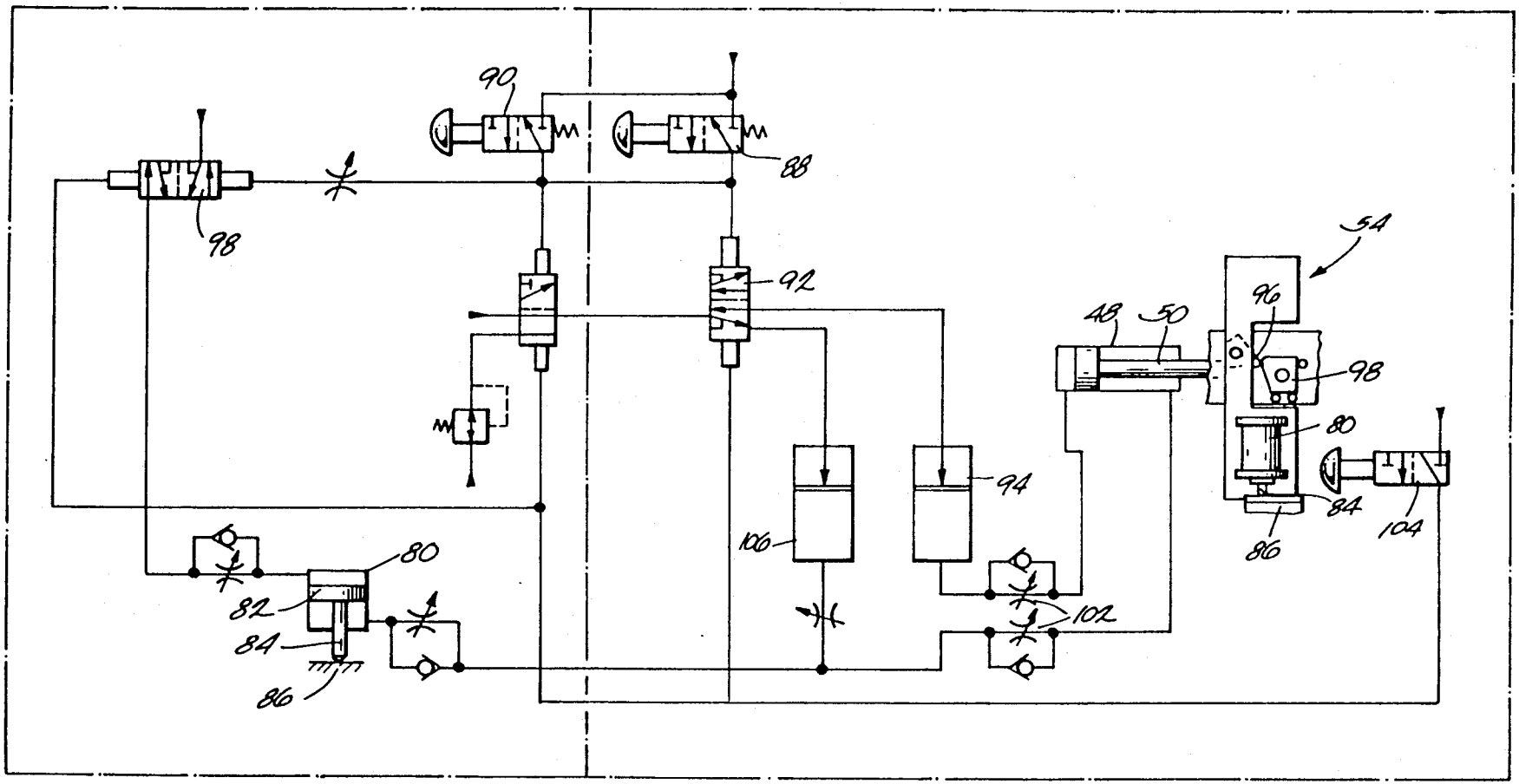

Another embodiment of the invention is shown in FIGS. 7 through 9. This embodiment is provided specifically for the purpose of dressing a grinding wheel 79 with a flat face or a reverse angle of incline, as shown in FIG. 7. With that type of wheel, a cam will not have a smoothly upwardly inclined face for causing the follower frame 54 to move upward as described above. Powered means must therefore be provided to furnish the necessary upward movement so that the dressing tool 44 properly dresses the wheel 79.

As shown in FIGS. 7 through 9, this powered means for upward movement is embodied as a linear actuator, and particularly a hydraulic cylinder 80, affixed to the follower frame 54. The cylinder 80 includes a piston 82 (FIG. 9) connected to a vertically oriented actuator rod 84. The distal end of the actuator rod 84 bears on a flat-topped land 86 attached to the dresser frame 26.

The hydraulic/pneumatic circuit for this embodiment is shown partially schematically in FIG. 9. As there shown, the circuit includes a first control valve 88 which controls the linear actuator 48, and a second control valve 90 which controls the cylinder 80. For clarity the cylinder 80 is shown twice in FIG. 9, once at the left side as it fits schematically into the circuit, and once at the right as it fits physically and functionally into the apparatus. In the embodiment shown in FIG. 9 the circuit is partially pneumatic and partially hydraulic, although this combination is not necessary to the invention.

To begin the dressing operation with this embodiment, the first control valve 88 is pressed, which causes a slide valve 92 to shift, permitting pressure to enter a reservoir 94. This in turn causes the actuated member 50 of the linear actuator 48 to advance, to the right as shown in FIG. 9, as in the embodiment described above. The actuated member 50 will continue to advance until the cam follower 96 of this embodiment contacts the cam 98, at which point the dressing tool 44 is in contact with the wheel 79. In this embodiment, however, because the shape of the cam 98 to which this embodiment is directed is such as to not cause the follower frame 54 to rise, the actuator 48 simply stops when the follower 96 contacts the cam. The follower 96 in this embodiment is advantageously shaped in a different way, or alternatively simply rotated from the embodiment shown in FIG. 1, to permit the follower to properly interact with the cam 98 as required in this embodiment.

When the follower 96 contacts the cam 98 and the actuator 48 stops, the operator then presses the second control valve 90, which causes another slide valve 100 to shift, in turn forcing the piston 82 and actuator rod 84 of the cylinder 80 to move downward. When the rod 84 contacts the land 86, and thereafter continues to extend, the follower frame 54 will be raised. If the face of cam 98 is completely flat and vertical, the movement of the follower frame 54 will be entirely vertical. If, however, the face of cam 98 is angled backwardly to some extent, as shown in FIGS. 7 and 9, the follower frame 54 will be required to move backward to that same extent as the follower 96 follows the contour of the cam 98. To permit this backward movement, flow restrictors 102 are provided in the supply lines to the actuator 48, to reduce the pressure applied by the actuator compared to that of the embodiment shown in FIGS. 1 through 6.

When the follower 96 reaches the top of the cam 98, as shown in phantom in FIG. 7, the actuator 48 again moves the follower 96, and hence the dressing tool 44, forward, now along the top of the cam. At a predetermined point, the follower frame 54 contacts an end valve 104. As shown in FIG. 9, this end valve 104 switches first slide valve 92, to shift pressure from the first reservoir 94 to a second reservoir 106. Since the second reservoir 106 is connected to the return side of both linear actuator 48 and cylinder 80, the follower frame 54 is returned to its starting position.

Hence the invention provides an apparatus for dressing a grinding wheel 14 which is more positive in its action and which is capable of dressing wheels that have different shapes than apparatus available in the prior art.

While the apparatus hereinbefore described is effectively adapted to fulfill the aforesaid objects, it is to be understood that the invention is not intended to be limited to the specific preferred embodiment of semi-automatic dressing accessory set forth above. Rather, it is to be taken as including all reasonable equivalents within the scope of the following claims.

We claim:

1. A dresser apparatus for dressing a grinding wheel to a desired cross sectional shape, which grinding wheel is caused to continuously rotate about an axis with respect to a drill pointer base by prime mover means, said dresser comprising:

a dresser base affixed substantially immovable with respect to said drill pointer base;

a dresser frame connected to said dresser base;

a follower carriage slidably connected to said dresser frame so as to permit movement of said follower carriage with respect to said dresser frame substantially linearly along a first path substantially radial to said axis and also substantially linearly along a second path substantially parallel to said axis;

first linear actuator means for causing said follower carriage to slide along said first path;

a cam attached to said dresser frame, having a cam surface corresponding to the desired shape of the grinding wheel;

a cam follower attached to said follower carriage and positioned thereon so as to bear on said cam surface of said cam;

second linear actuator means for causing said follower carriage to slide along said second path, thereby causing said follower carriage to move along said first and second paths according to the shape of said cam surface; and a grinding wheel dressing tool carried by said follower carriage and positioned so as to bear on and dress said grinding wheel in conformity with the shape of said cam surface.

2. A dresser apparatus as recited in claim 1 wherein said follower carriage comprises:

a slider block mounted to said dresser frame for sliding movement with respect to said dresser frame along said first path; and a follower frame mounted to said slider block for sliding movement with respect to said follower frame along said second path.

3. A dresser apparatus as recited in claim 2 wherein said dressing tool is attached to a dresser arm, in turn attached to said follower frame, said attachment of said dressing tool to said dresser arm being at an oblique angle with respect to said grinding wheel axis.

4. A dresser apparatus as recited in claim 3 wherein said oblique angle is 50 degrees.

5. A dresser apparatus as recited in claim 1 wherein said dresser frame is slidable with respect to said dresser base, permitting adjustment of said apparatus for removal of material from said grinding wheel in the dressing operation.

6. A dresser apparatus as recited in claim 5 wherein said dresser frame is slidable with respect to said dresser base by means of a screw, said screw including markings for indicating the distance said dresser frame has moved with respect to said dresser base.

7. In a drill point grinder including a base and having a grinding wheel continuously rotating about a grinding wheel axis with respect to said base, a grinding wheel dresser for dressing said grinding wheel to a predetermined cross sectional shape, comprising:

a dresser frame connected to said base;

a slider block mounted to said dresser frame and slidable with respect to said frame along a first sliding path substantially perpendicular to said grinding wheel axis by means of a first linear actuator;

a cam affixed to said dresser frame and having a cam surface the shape of which corresponds to said predetermined cross sectional shape;

a follower frame slidably mounted to said slider block so as to be slidable with respect to said slider block along a second path substantially parallel to said axis by means of a second linear actuator;

cam follower means affixed to said follower frame and bearing upon said cam such that said follower frame moves along said first and second paths in conformance with said cam surface; and a dressing tool connected to said follower frame and positioned so as to bear on said grinding wheel, thereby dressing said grinding wheel to said predetermined shape.

8. A combination as recited in claim 7 wherein said dressing tool is connected to said follower frame at an oblique angle with respect to said axis.

9. A combination as recited in claim 8 wherein said oblique angle is 50 degrees.

10. A combination as recited in claim 7 wherein said dresser frame connection to said dresser base is slidable, permitting adjustment of said apparatus for removal of material from said grinding wheel in the dressing operation.

11. A combination as recited in claim 10 wherein said dresser frame is slidable with respect to said dresser base by means of a screw, said screw including markings for indicating the distance said dresser frame has moved with respect to said dresser base.

12. A apparatus for dressing a grinding wheel to a predetermined cross sectional shape, comprising:

means for rotating said wheel continuously about an axis with respect to a base;

a dresser frame connected to said base;

a slider block mounted to said dresser frame and slidable with respect to said frame along a first path substantially radial to said axis by means of a first linear actuator;

a cam affixed to said dresser frame and having a cam surface the shape of which corresponds to said predetermined cross sectional shape;

a follower frame slidably mounted to said slider block so as to be slidable with respect to said slider block in a second path substantially parallel to said axis by means of a second linear actuator;

cam follower means affixed to said follower frame and bearing upon said cam such that said follower frame is moved in conformance with said cam surface shape; and a dressing tool connected to said follower frame and positioned at an oblique angle with respect to said axis, so as to bear on said grinding wheel, thereby dressing said grinding wheel to said predetermined shape.

13. An apparatus as recited in claim 12 wherein said oblique angle is 50 degrees.

14. An apparatus as recited in claim 12 wherein said dresser frame connection to said base is slidable, permitting adjustment of said apparatus for removal of material from said grinding wheel in the dressing operation.

15. An apparatus as recited in claim 14 wherein said dresser frame is slidable with respect to said base by means of a screw, said screw including markings for indicating the distance said dresser frame has moved with respect to said base.

* * * * *